US010690464B2

(12) United States Patent
Peterson

(10) Patent No.: US 10,690,464 B2
(45) Date of Patent: Jun. 23, 2020

(54) CARTRIDGE WITH COMBINED EFFECTS PROJECTILE

(71) Applicant: Vista Outdoor Operations LLC, Farmington, UT (US)

(72) Inventor: Bryan P. Peterson, Isanti, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 15/967,169

(22) Filed: Apr. 30, 2018

(65) Prior Publication Data

US 2018/0313639 A1 Nov. 1, 2018

Related U.S. Application Data

(60) Provisional application No. 62/659,952, filed on Apr. 19, 2018, provisional application No. 62/492,058, filed on Apr. 28, 2017.

(51) Int. Cl.

| | |
|---|---|
| ***F42B 12/74*** | (2006.01) |
| ***F42B 12/36*** | (2006.01) |
| ***F42B 12/78*** | (2006.01) |

(52) U.S. Cl.

CPC ..... *F42B 12/367* (2013.01); *F42B 12/74* (2013.01); *F42B 12/745* (2013.01); *F42B 12/78* (2013.01)

(58) Field of Classification Search

CPC ..... F42B 12/34; F42B 12/74; F42B 12/76; F42B 12/367

USPC ..... 102/507, 508, 509, 510

See application file for complete search history.

(56) References Cited

U.S. PATENT DOCUMENTS

| | | | |
|---|---|---|---|
| 90,732 | A | 6/1869 | Curtis |
| 355,653 | A | 1/1887 | Loyd |
| 682,364 | A | 9/1901 | Cartridge |
| 740,914 | A | 10/1903 | Platz |
| 914,992 | A | 3/1909 | Taylor |
| 1,328,334 | A | 1/1920 | Newton |
| 1,380,773 | A | 6/1921 | Clay |

(Continued)

FOREIGN PATENT DOCUMENTS

| | | | |
|---|---|---|---|
| CA | 2414149 A1 * | 12/2001 | ..... F42B 12/34 |
| DE | 583097 | 8/1933 | |

(Continued)

OTHER PUBLICATIONS

"Russian Handgun Ammo With Steel Forward Portion" downloaded from the internet at: https://www.ar15.com/forums/general/Why_not_make_some_legal_handgun_AP_to_get_the_BATFE_back_for_7N6_and_M855_UPDATE_with_380_on_pg_5/5-1721610/&page=3 (8 pgs).

(Continued)

*Primary Examiner* — Stephen Johnson

(74) *Attorney, Agent, or Firm* — Reed Smith LLP; Matthew P. Frederick; Cheryl L. Gastineau

(57) ABSTRACT

A cartridge comprising a bullet, the bullet providing a radially expanding array of bullet fragments upon entering a target and also providing an increase in effective surface area of the bullet within the target by structural features that facilitate tumbling or mushrooming in the target. In an embodiment a pair of axial core members are aligned in a bullet jacket with the forward core member being segmented with separation junctures formed by engaged faces of adjacent segments. Impact causing fracturing of the segments from a base portion.

9 Claims, 11 Drawing Sheets

(56) References Cited

U.S. PATENT DOCUMENTS

| | | | |
|---|---|---|---|
| 1,432,669 | A | 10/1922 | Clay |
| 1,709,414 | A | 4/1929 | Stendebach |
| 1,967,416 | A | 7/1934 | Leussler |
| 2,661,694 | A | 12/1953 | Allen et al. |
| 2,683,416 | A | 7/1954 | Keller et al. |
| 2,932,253 | A | 4/1960 | Auxier |
| 2,958,287 | A | 11/1960 | Auxier |
| 3,003,420 | A | 10/1961 | Nosler |
| 3,103,889 | A | 9/1963 | Keeney, Sr. |
| 3,142,256 | A | 7/1964 | Mack |
| 3,230,886 | A | 1/1966 | Woodring |
| 3,374,740 | A | 3/1968 | Voda |
| 3,616,758 | A | 11/1971 | Komarov |
| 3,720,170 | A | 3/1973 | Godfrey |
| 3,756,158 | A | 9/1973 | Anderson |
| 3,853,059 | A | 12/1974 | Moe |
| 4,048,922 | A | 9/1977 | Buljovcic |
| 4,108,074 | A | 8/1978 | Billing, Jr. et al. |
| 4,128,059 | A | 12/1978 | Black |
| 4,136,616 | A | 1/1979 | Schirneker |
| 4,338,862 | A | 7/1982 | Kwatnoski et al. |
| 4,517,898 | A | 5/1985 | Davis et al. |
| 4,550,662 | A | 11/1985 | Burczynski |
| 4,587,905 | A | 5/1986 | Maki |
| 4,610,061 | A | 9/1986 | Halverson |
| 4,619,203 | A | 10/1986 | Habbe |
| 4,625,650 | A | 12/1986 | Bilsbury |
| 4,777,882 | A | 10/1988 | Dieval |
| 4,836,110 | A | 6/1989 | Burczynski |
| 4,856,160 | A | 8/1989 | Habbe et al. |
| 4,884,508 | A | 12/1989 | Kruse et al. |
| 4,947,755 | A | 8/1990 | Burczynski |
| 5,079,814 | A | 1/1992 | Moore et al. |
| 5,094,169 | A | 3/1992 | Evitts |
| 5,101,732 | A | 4/1992 | Schluckebier |
| 5,131,123 | A | 7/1992 | Brooks |
| 5,133,261 | A | 7/1992 | Kelsey, Jr. |
| 5,149,913 | A | 9/1992 | Arakaki |
| 5,187,325 | A | 2/1993 | Garvison |
| 5,208,424 | A | 5/1993 | Schluckebier et al. |
| 5,259,320 | A | 11/1993 | Brooks |
| 5,263,418 | A | 11/1993 | Dippold et al. |
| 5,339,743 | A | 8/1994 | Scarlata |
| 5,357,866 | A | 10/1994 | Schluckebier et al. |
| 5,375,529 | A | 12/1994 | Knight, Jr. et al. |
| 5,399,187 | A | 3/1995 | Mravic et al. |
| 5,400,716 | A | 3/1995 | Mayer |
| 5,454,325 | A | 10/1995 | LeBlanc |
| 5,528,989 | A | 6/1996 | Briese |
| 5,528,990 | A | 6/1996 | Corzine et al. |
| 5,621,186 | A | 4/1997 | Carter |
| 5,665,808 | A | 9/1997 | Bilsbury et al. |
| 5,679,920 | A | 10/1997 | Hallis et al. |
| 5,801,324 | A | 9/1998 | Pickard |
| 5,811,723 | A | 9/1998 | Stone |
| 5,943,749 | A | 8/1999 | Swank |
| 6,024,021 | A | 2/2000 | Schultz |
| 6,048,379 | A | 4/2000 | Bray et al. |
| 6,085,661 | A | 7/2000 | Halverson et al. |
| 6,115,894 | A | 9/2000 | Huffman |
| 6,148,731 | A | 11/2000 | Winter |
| 6,182,574 | B1 | 2/2001 | Giannoni |
| 6,305,292 | B1 | 10/2001 | Burczynski et al. |
| 6,305,293 | B1 | 10/2001 | Fry et al. |
| 6,374,743 | B1 | 4/2002 | Hug et al. |
| 6,484,642 | B1 | 11/2002 | Kuhns et al. |
| 6,598,536 | B2 | 7/2003 | Burri |
| 6,694,888 | B2 | 2/2004 | Jopson et al. |
| 6,752,084 | B1 | 6/2004 | Husseini et al. |
| 6,776,101 | B1 | 8/2004 | Pickard |
| 6,805,057 | B2 | 10/2004 | Carr et al. |
| 6,845,717 | B1 | 1/2005 | Sauvestre |
| 6,862,993 | B1 | 3/2005 | Cudazzo |
| 6,935,243 | B2 | 8/2005 | Dippold |
| 6,971,315 | B2 | 12/2005 | Knappworst et al. |
| 7,150,233 | B1 | 12/2006 | Eberhart |
| 7,162,942 | B2 | 1/2007 | Dippold |
| 7,380,502 | B2 | 6/2008 | Emary |
| 7,455,015 | B2 | 11/2008 | Krstic |
| 7,493,862 | B2 | 2/2009 | Orlanov |
| 7,503,260 | B2 | 3/2009 | Kapeles |
| 7,607,394 | B2 | 10/2009 | Cesaroni |
| 7,681,504 | B2 | 3/2010 | Machina et al. |
| 7,743,708 | B1 | 6/2010 | Lawrence |
| 7,748,325 | B2 | 7/2010 | Marx |
| 8,186,277 | B1 | 5/2012 | King |
| 8,393,273 | B2 | 3/2013 | Weeks et al. |
| 8,413,587 | B2 | 4/2013 | Emary |
| 8,578,856 | B2 | 11/2013 | Riess et al. |
| 8,646,389 | B2 | 2/2014 | Masinelli |
| 8,752,484 | B2 | 6/2014 | Burczynski |
| 8,857,343 | B2 | 10/2014 | Marx |
| 8,881,654 | B2 | 11/2014 | Seecamp |
| 8,950,333 | B2 | 2/2015 | Burczynski et al. |
| 9,046,333 | B2 | 6/2015 | Masinelli |
| 9,052,174 | B2 | 6/2015 | Dennison |
| 9,121,677 | B2 | 9/2015 | Emary |
| 9,200,878 | B2 | 12/2015 | Seecamp |
| 9,207,052 | B2 | 12/2015 | Burczynski |
| 9,354,027 | B2 | 5/2016 | Flint et al. |
| 9,366,512 | B2 | 6/2016 | Burczynski et al. |
| 9,383,178 | B2 * | 7/2016 | Powers, Jr. ..... F42B 12/34 |
| 9,551,555 | B2 | 1/2017 | Flint et al. |
| 9,797,696 | B2 | 10/2017 | Golloher et al. |
| 9,841,260 | B2 | 12/2017 | Lemke et al. |
| 9,863,746 | B2 | 1/2018 | Peterson |
| 1,007,291 | A1 | 9/2018 | Flint et al. |
| 1,008,237 | A1 | 9/2018 | Imhoff et al. |
| 2002/0056397 | A1 * | 5/2002 | Carr ..... F42B 12/34 102/509 |
| 2002/0178963 | A1 | 12/2002 | Halverson |
| 2003/0145755 | A1 | 8/2003 | Briese |
| 2003/0192425 | A1 | 10/2003 | Olin |
| 2005/0126422 | A1 | 6/2005 | Lamm |
| 2005/0183617 | A1 | 8/2005 | MacDougall |
| 2006/0027129 | A1 | 2/2006 | Kolb et al. |
| 2006/0027132 | A1 | 2/2006 | Libra |
| 2006/0283314 | A1 | 12/2006 | Cesaroni |
| 2007/0017409 | A1 | 1/2007 | Mansfield et al. |
| 2007/0131131 | A1 | 6/2007 | Stock, Jr. et al. |
| 2008/0092768 | A1 | 4/2008 | Krstic |
| 2008/0196616 | A1 | 8/2008 | Cziglenyi |
| 2008/0314280 | A1 | 12/2008 | Martini Filho |
| 2010/0018430 | A1 | 1/2010 | Masinelli et al. |
| 2010/0184301 | A1 | 7/2010 | Wagner et al. |
| 2010/0224093 | A1 | 9/2010 | Wilhelm et al. |
| 2012/0111220 | A1 | 5/2012 | King |
| 2012/0199035 | A1 | 8/2012 | Frank |
| 2013/0025490 | A1 | 1/2013 | Burczynski |
| 2013/0092041 | A1 | 4/2013 | Seecamp |
| 2014/0130699 | A1 | 5/2014 | Peterson et al. |
| 2014/0283707 | A1 | 9/2014 | Reiss |
| 2015/0308799 | A1 | 10/2015 | Powers, Jr. |
| 2015/0330751 | A1 | 11/2015 | Flint et al. |
| 2016/0047638 | A1 | 2/2016 | Golloher et al. |
| 2016/0231093 | A1 | 8/2016 | Lemke et al. |
| 2016/0282095 | A1 * | 9/2016 | Hendrixson ..... F42B 12/34 |
| 2017/0248395 | A1 | 8/2017 | Riess |
| 2017/0261294 | A1 | 9/2017 | Riess |

FOREIGN PATENT DOCUMENTS

| | | |
|---|---|---|
| DE | 3116175 | 11/1982 |
| DE | 3638721 | 5/1987 |
| DE | 3802002 | 8/1989 |
| DE | 3822775 | 2/1990 |
| DE | 10010500 | 9/2001 |
| DE | 102012023398 | 6/2014 |
| DE | 202014103662 U1 | 8/2014 |
| EP | 989381 | 3/2000 |
| EP | 2551630 | 1/2013 |
| EP | 2792993 | 11/2015 |
| FR | 420390 | 1/1911 |
| GB | 6588 | 1/1897 |

(56) References Cited

FOREIGN PATENT DOCUMENTS

| | | |
|---|---|---|
| GB | 8301 | 4/1910 |
| RU | 2003033 | 11/1993 |
| RU | 2453800 | 4/2012 |
| RU | 2469259 | 4/2012 |
| RU | 2453803 | 6/2012 |
| WO | WO199720185 | 6/1997 |
| WO | WO2001002794 | 1/2001 |
| WO | WO2001020245 | 3/2001 |
| WO | WO2014186007 | 11/2014 |
| WO | WO2017015665 | 1/2017 |

OTHER PUBLICATIONS

"Three New Ammo Brands From Winchester" downloaded from the internet at http://www.thetruthaboutguns.com/2018/02/jeremy-s/three-new-ammo-brands-winchester/ (Jul. 16, 2018) 19 pgs.

"Esp Raptor Bullet Recognized by Hunters Worldwide" downloaded from the internet on Oct. 8, 2018 at: https://www.ammoland.com/2012/03/esp-raptor-bullet-recognized-by-hunters-worldwide/#axzz5TMi86Ors 2 pgs.

Leigh Defense's Hyper Velocity Machined Hollowpoint Video dated Jun. 22, 2013 https://www.youtube.com/watch?v=hvt3Cfuvlp8.

Video from NRA 2012 Convention https://www.youtube.com/watch?v=yzQhakHnlc.

* cited by examiner

CARTRIDGE WITH COMBINED EFFECTS PROJECTILE

CROSS-REFERENCE TO RELATED APPLICATIONS

This application claims the benefit of U.S. Provisional Application No. 62/659,952, filed Apr. 19, 2018 and U.S. Provisional Application No. 62/492,058, filed Apr. 28, 2017, the entire contents of which are incorporated by reference herein.

BACKGROUND OF THE INVENTION

Maximum stopping power is desirable in small arms ammunition utilized for hunting, personal protection, and law enforcement. Stopping power correlates to energy transfer from the bullet to the fluidic target which is associated with maximizes damage to the target. Conventional handgun ammunition, for personal protection and law enforcement may often be designed to "upset" or "mushroom" upon impact thereby presenting an enhanced surface area to the fluidic target and thereby the projectile will often dissipate its entire energy in the target while generating a significant wound cavity. Other ammunition may rely upon the bullet tumbling upon entering the target to cause maximum damage or injury and that dissipates the bullets energy and generates a significant wound cavity. Bullets that remain intact and do not tumble in a target often pass through the target reducing damage or injury to the target and may create a hazard to personnel behind the intended target. Other known ammunition have bullets that fragment, such fragmentation in small arms has been disfavored as smaller fragments may be inconsistent in the damage they inflict upon targets and often have a reduced wound cavities. Efforts have been made to prevent fragmentation of mushrooming bullets as such was deemed disadvantageous. One advantage to fragmenting projectiles is that fragments that disperse from the direct bullet path provide a greater chance of hitting a vital component in a soft fluidic target that is displaced from the direct bullet path.

Any improvement to the stopping power of small arms ammunition would be welcome by consumers and law enforcement.

SUMMARY OF THE INVENTION

In embodiments herein a bullet of a cartridge is provided with controlled fragmentation and dispersion of the fragmentation upon target entry as well as providing a bullet portion that comprises a substantial portion of the original bullet and that has a controlled mushrooming and/or tumbling effect. In embodiments, a jacketed bullet has a pair of axially arranged cores, a forward core and a rearward core, within the jacket, the rearward core having a cylindrical outer surface engaging the jacket. The forward core having an ogival exterior forward surface that may follow an interior wall surface of the jacket and a rearward cylindrical surface. The forward ogival portion may have a central recess commonly referred to as a hollow point. The forward core having circumferentially spaced core segments positioned about an axis of the bullet, the core segments being separated from one another in the final bullet or during the bullet forming so as to form parting or separation junctures of the core segments from one another. The separation junctures, which may be planar or non-planar shaped separation junctures, with opposing faces of adjacent core segments confronting and engaging each other. Each separation juncture extending radially outward from the radius. The core segments formed to separate upon impact with a target radially outward in a dispersed star shaped pattern. The jacket having a forward portion with axially extending tear guides configured as creases, skives, folds or the like, to facilitate pedaling of the jacket upon target entry. The tear guides may be arranged to correspond to the core segments. The core segments may be unitary with a non-segmented core portion whereby when the segments separate, there is a tearing at bases of the core segments In an embodiment, a bullet core has a plurality of circumferentially spaced segments separated from one another. In embodiments, the segments have a separation defined by a gap, the gap extending axially at least 30% of the axial length of the bullet. In embodiments, the gap extending at least 20% of the axial length of the bullet. The segments unitary and homogeneous with a non-segmented portion of the core rearward of the plurality of circumferentially spaced segments. The segments configured to separate from the non-segmented portion of the core upon impact. In embodiments, the segments are positioned around a pillar portion extending from the non-segmented portion. Whereby when the segments separate, axially extending cut-out regions are defined on the forward exterior surface of the bullet facilitating tumbling of the bullet in the target. The central pillar portion may remain intact with the non-segmented portion in the target, shifting the center of gravity rearward, facilitating tumbling of the non-segmented portion. The concave cut-outs also destabilize the non-segmented portion with the pillar portion facilitating tumbling.

A feature and advantage of embodiments is that the attributes of conventional mushrooming bullet are provided as well as the advantages of a fragmenting bullet. Moreover, the fragmentation occurs in a predefined pattern of a radially expanding array, maximizing stopping potential of the bullet.

A feature and advantage of embodiments is that the cartridge and bullet as shown may be manufactured with conventional manufacturing techniques and tools, thereby providing an enhanced round with minimal or no additional manufacturing expense.

A feature and advantage of embodiments is a projectile that upon mushrooming, the petals release minor projectile components radially outward from the primary projectile track and the mushroomed projectile component continues to track substantially along the primary projectile track. In embodiments the minor projectile components constitute less than 50% of the original mass of the projectile A feature and advantage of embodiments is a projectile that provides a tumbling effect upon hitting a target but also provides an early pre-tumble fragmentation, the fragmentation being provided in a predefined radially expanding array.

DETAILED DESCRIPTION

Figure 1:
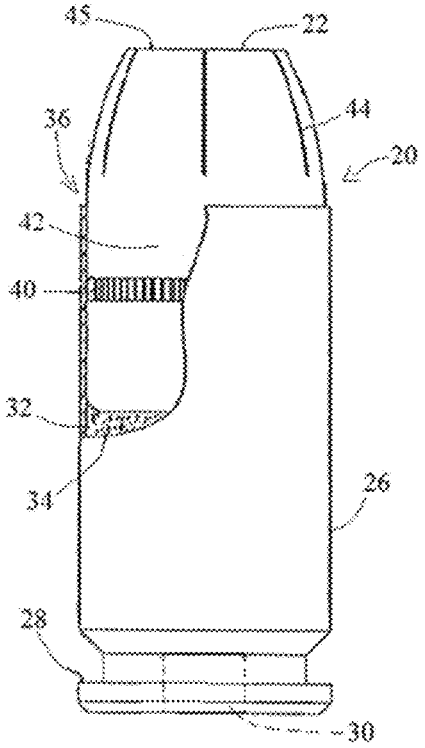
FIG. 1 is a partial sectional of a handgun cartridge according to embodiments.

Referring to FIG. 1, a handgun cartridge 20 with a bullet 22 is depicted. The cartridge 20 has a conventional casing 26 with a casing head 28 having a primer 30. The casing 26 defining an interior 32 with propellant 34 therein and a mouth 36 with the bullet 22 therein. The bullet 22 has a cannelure 40 inset in a jacket 42 of the bullet 22. The cannelure 40 may be functional to secure a rearward core (not shown in this view) of the bullet 22 to the jacket 42 upon entering a target and may also be utilized to limit pedaling of the jacket 42. Folds, creases, or skives 44 extend axially on the jacket 42 and may accommodate the converging configuration of the jacket 42 toward the tip 45 of the bullet 22 in that jackets are typically tubular in shape prior to forming into the converging shape. As described further below, the folds, creases, or skives 44 may function as pedal forming or tearing guides.

Figure 2:
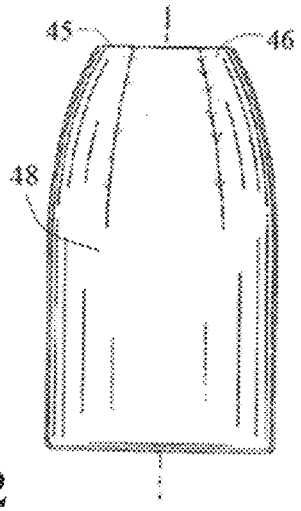
FIG. 2 is an elevation view of a bullet according to embodiments.
Figure 3:
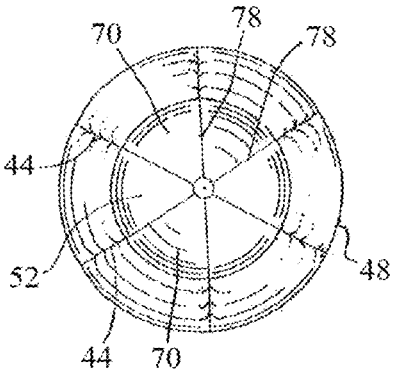
FIG. 3 is a top plan view of the bullet of FIG. 2.
Figure 4:
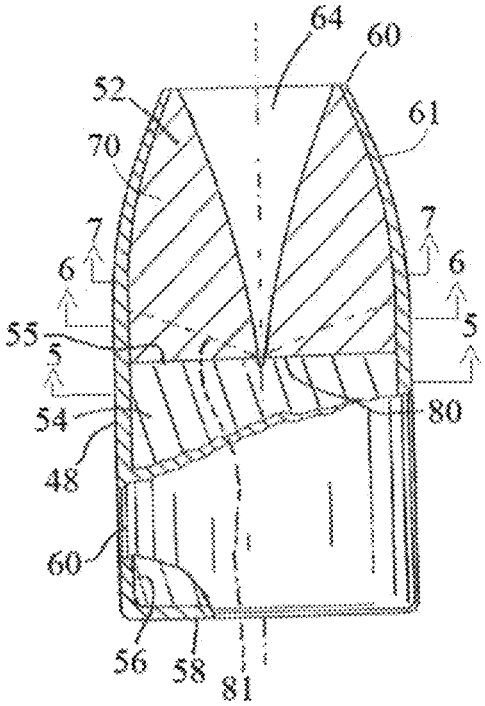
FIG. 4 is partial sectional view of a bullet according to embodiments herein.

FIGS. 2, 3, and 4 illustrate a bullet 46 without a cannelure, also suitable for use in the cartridge 20 of FIG. 1. The bullet 46 has a forward core member 52 and rearward core member 54 meeting at a juncture 55 and in axial alignment positioned inside the jacket 48. The jacket 48 includes a rearward circular wall 58 unitary with a tubular wall 60 and an inside wall surface 56. The jacket 48 secures the core members 52, 54, therein with engagement of the core members 52, 54, with the inside wall surface 56 of the jacket 48.

At a forward end 61 of the projectile or bullet 46, a cavity configured as a central recess 64 is defined by the forward core 52, providing what is known as a hollow point bullet. In embodiments, the forward core 52 has a plurality of core segments 70, numbering 6 in the exemplary illustration. The core segments 70 may, of course, be of other quantities and may be formed generally as described in U.S. Pat. No. 6,805,057, which is herein incorporated by reference for all purposes and owned by the owner of the instant application. In embodiments, the central recess may have material, such as elastomeric material, or a tip therein.

A punch may separate the segments 70, defining faces of each segment 70, and the jacket 48 and cores 52, 54, may be swaged together in suitable forms. Each core segment has an outer face 71 and a pair of internal faces 72, 74, that engage respective apposing faces of adjacent segments 70. The adjacent faces 72, 74, define separation junctures 78 that may extend to or are proximate to a rear face 80 of the forward core member 52.

As illustrated in FIG. 4, the separation junctures 78 may extend from the cavity 64 rearward to the rear face 80 near the axial center and then be more displaced from the rear face 80 towards the outer circumferential surface of the forward core member 52 as indicated by the dashed line indicating the rearward margins 81 of the separation junctures 78 in the illustrated embodiment.

Figure 5:
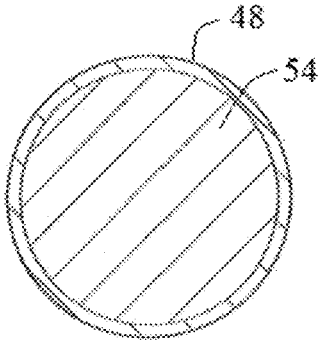
FIG. 5 is a sectional view taken at line 5-5 of FIG. 4
Figure 6:
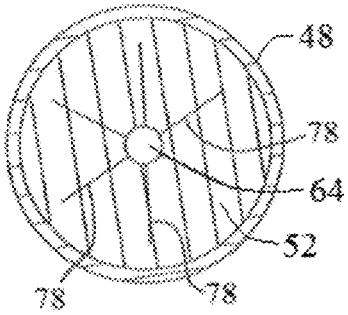
FIG. 6 is a sectional view taken at line 6-6 of FIG. 4.
Figure 7:
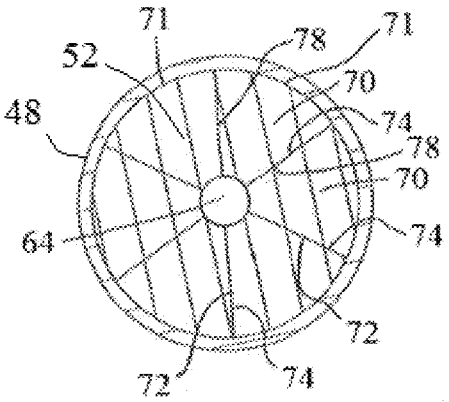
FIG. 7 is a sectional view taken at line 7-7 of FIG. 4.

FIGS. 5-7 show cross-sections of the bullet 46 of FIG. 4 along lines 5-5, 6-6 and 7-7, respectively. The cross-section of FIG. 5 is rearward of the rear face 80 of forward core member 52 and therefore shows the rearward core member 54. The cross-section of FIG. 6 is just forward of the rear face 80 and just shows the forward core member 52. As can be seen, the cross-section of FIG. 6 crosses the angled rearward margins 81 of the separation junctures 78 such that the separation juncture 78 do not extend to the outer circumferential surface of the forward core member 52. The cross-section of FIG. 7 is forward of the rear face 80 and the angled rearward margins 81 of the separation junctures 78 and thus shows just the forward core member 52 with the separation juncture 78 extending to the outer circumferential surface of the forward core member 52, In certain embodiments, the cavity 64 may not extend rearward fully to the rear face 80, but may be a shallower cavity. In certain embodiments, the cavity 64 may be filled, such as with elastomeric material as described in U.S. Patent Publication US 2005/0126422, said application incorporated herein by reference for all purposes.

The jacket 48 includes skives, creases, or folds 44 that may be aligned with the separation junctures 78, as best shown in FIG. 3, and as described in the '057 patent.

Upon the projectile 46 of FIGS. 2-7 striking a soft target, such as the gel block as illustrated in FIG. 11, hydraulic forces in the cavity 64 force the core segments 70 and jacket 48 radially outward and the bullet 46 begins to expand. The separation junctures 78 extend sufficiently rearward that the outward hydraulic forces cause separating and/or tearing of the core segments 70 along the separation juncture paths 78 and at the rear face 80, resulting in complete separation of the segments 70 from one another and the rearward core member 54. The separating and expansion further causes pedaling of the jacket 48 after the jacket 48 tears or opens along the creases, folds, or skives 44. FIGS. 8A-9B illustrate petals 84 formed upon impact and expansion of the bullet 46 and expansion of the rearward core member 54 maintained within the rearward tubular wall 60 of the jacket 48.

Figure 8A:
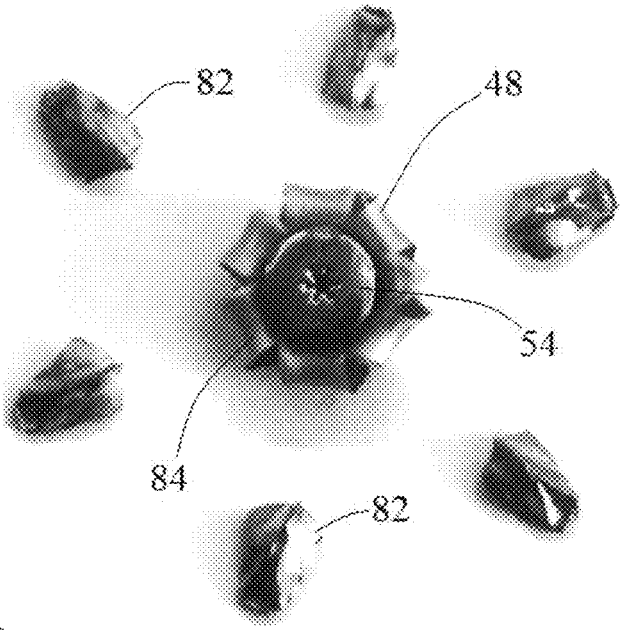
FIGS. 8A-8C are illustrations of the bullet components of the bullet of FIG. 4 after entry into a soft target.
Figure 8B:
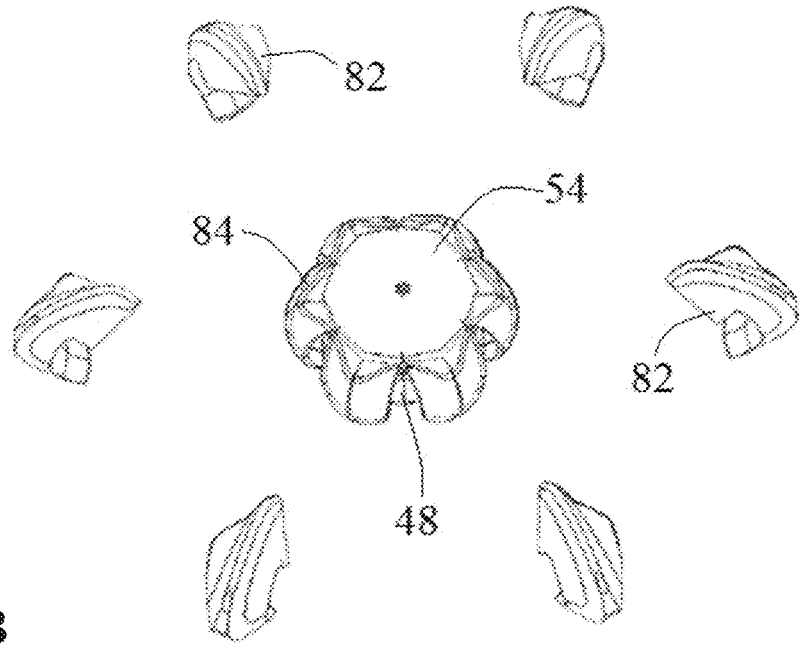
Figure 8C:
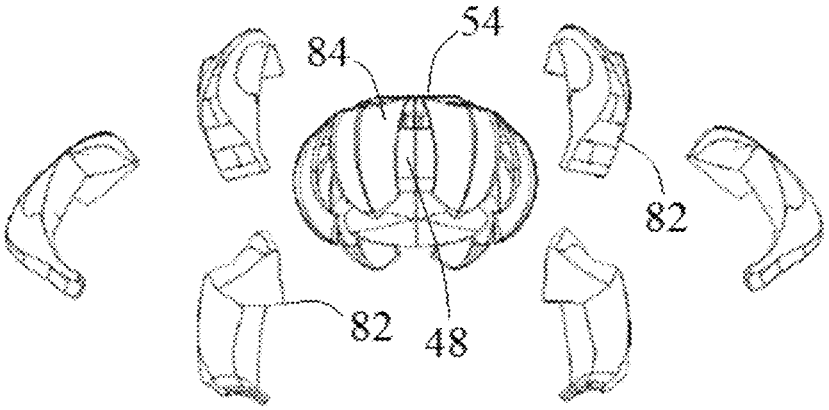
Figure 9A:
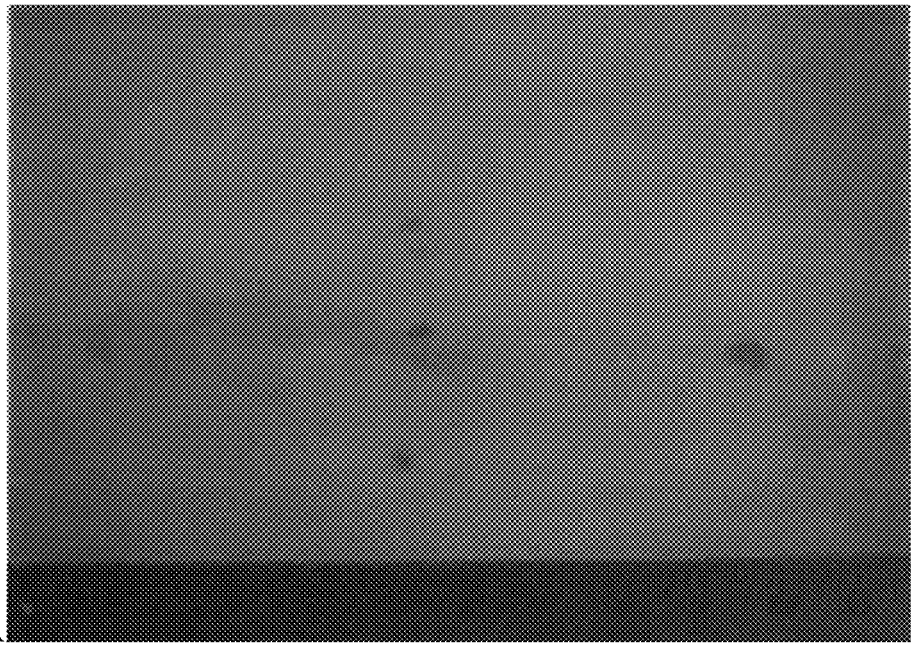
FIG. 9A is photo image of bullet component paths in a gel block soft target of embodiments.
Figure 9B:
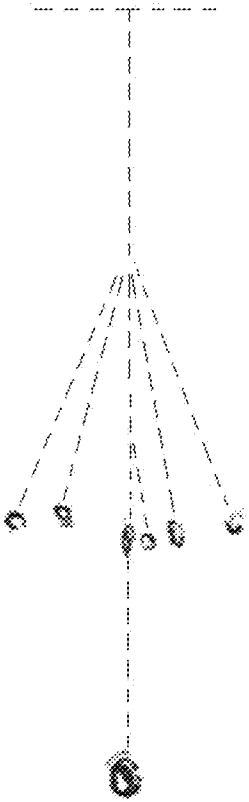
FIG. 9B is a drawing illustrating the cone shaped dispersion pattern of combined terminal effects projectile embodiments.

In embodiments, a punch that forms the core segments in the forward core may extend into the rear core, particularly at the central portion of the rear core as shown in FIG. 8A. The core cuts by said punch are not sufficient to allow fragmentation of the rear core.

In that the core segments 70 are not attached to each other or to the rearward core member 52, the outward hydraulic force of the soft target in the cavity 64 causes the segments 70 to release and launch as fragments 82 radially outward in a pattern corresponding to the arrangement in the jacket 48.

FIGS. 8A-9B illustrate the expansion and fragmentation of the bullet 46. In embodiments, the size of the core segments 70 is substantially maintained as they are released and launched as fragments 82. The forward inertial momentum of the segments 70 combined with the outward release and launching provides a path angled from the main projectile path in the range of 20 degrees to 40 degrees, in embodiments.

Figure 10:
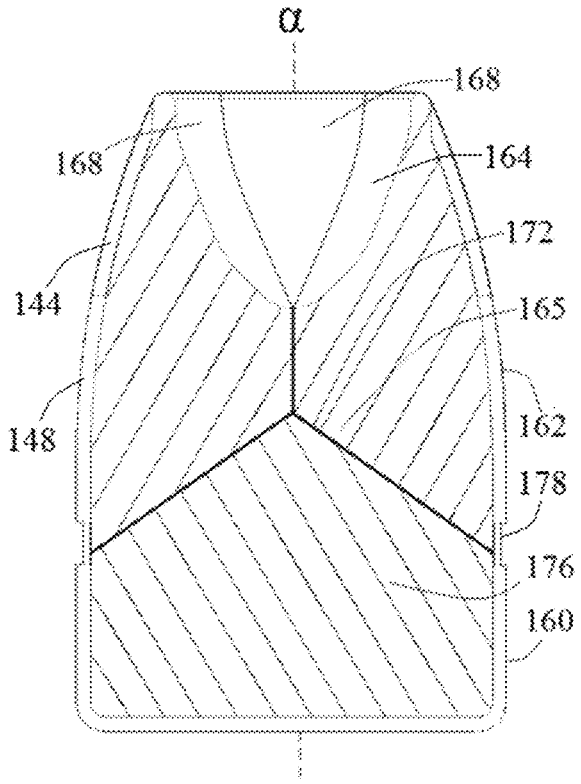
FIG. 10 is a cross sectional view of an embodiment with core segments.
Figure 14:
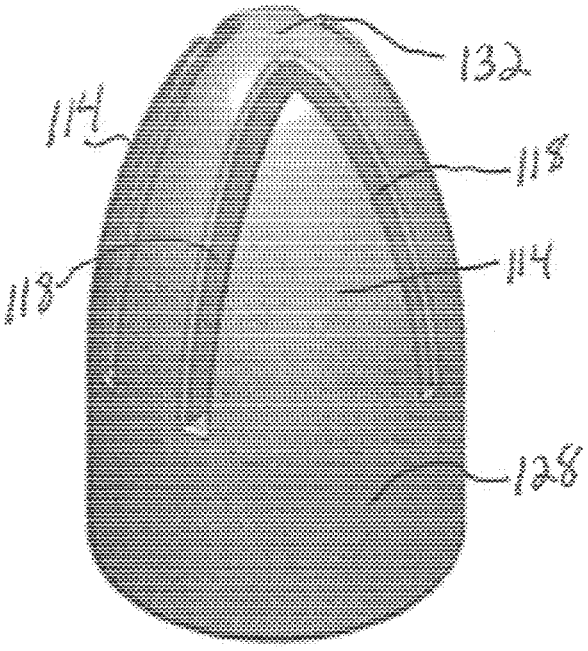
FIG. 14 is a perspective view of another embodiment of a projectile.

Referring to FIG. 10, another embodiment of a jacketed bullet 160 is illustrated. The bullet has a jacket 162 that surrounds a forward core portion 165 and a rear core portion 176. The forward core portion 165 includes forward segments 168 that are circumferentially spaced about the axis a. The segments 168 may vary in number. In an embodiment, as shown in FIG. 14, the bullet 160 may include six segments 168. As illustrated, the segments 168 may have separation juncture or planes that separate and define the segments 168 and a separation juncture 172 between the segments 168 of the forward core portion 165 from the rear core portion 176, such that, at impact and expansion of the bullet 160, the segments 168 separate and fragment without tearing of the core portions. The juncture 172 between the forward segments 168 and the rear core portion 176 is shown as conically shaped, but may of course have other shapes such as frustoconical or spherical. A cannelure 178 may act as a hinge with respect to jacket 148 separation. In some embodiments, the jacket 148 can include skives 144 and can separate and fragment with the segments 168. In embodiments, the forward and rear core portions may be lead.

The cores 52, 54, and jacket 48 may be formed of conventional materials, including but not limited to, copper and copper alloys for the jacket 48, and lead, copper and alloys thereof for the core members.

Referring to FIGS. 11A-14, an embodiment is a unitary bullet 110 or projectile according to embodiments is illustrated, the bullet 110 has a plurality of circumferentially spaced segments 114 separated from one another. In embodiments, the segments 114 are uniformly spaced. In embodiments, the segments 114 have a separation defined by cuts or gaps 118 between the segments 114 and side walls 121 of the pillar portion 132, the gaps 118 having a floor 119 and an axial length 122 extending axially at least 30% of the axial length 124 of the bullet 110. In embodiments, the gap 118 extending at least 20% of the axial length 124 of the bullet 110. In embodiments, the gap 118 extending at least 50% of the axial length 124 of the bullet 110. In embodiments, the gap 118 extending at least 60% of the axial length 124 of the bullet 110.

The gaps 118 may be a few thousandths of an inch thick to a few hundred thousandths of an inch thick. The segments 114 are unitary and homogeneous with a non-segmented portion 128 of the bullet 110. Such non-segmented portion 128 may be rearward of the plurality of circumferentially spaced segments 114 and be configured as a base 128 with a bottom 123.

The segments 114 are configured to separate from the non-segmented portion or base 128 of the bullet 110 upon impact. In embodiments, the segments 114 are positioned around a pillar portion 132 extending from the base 128, the gaps 118 being defined between the segments 114 and the pillar portion 132.

When the bullet 110 enters a soft target, such as a gel block, hydraulic fluid enters the gaps 118 and forces the segments 114 outwardly. The connection portions of the segments 114 to the base proximate the floors 119 of the gaps 118 are not flexible nor strong enough to resist fracturing or snapping under the hydraulic forces of the fluid. Under pressure from the hydraulic forces, the segments 114 fracture apart from the base 128 and are launched radially outward, as illustrated in FIGS. 12A-12B.

Figure 12A:
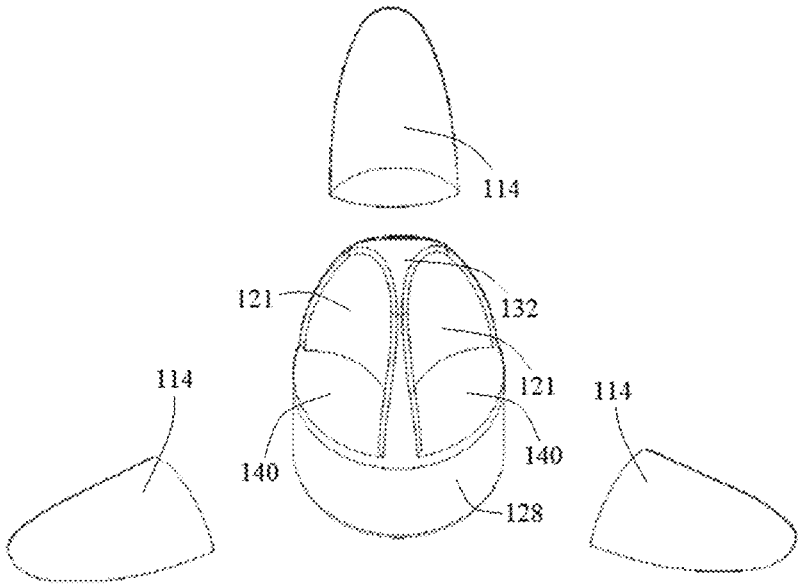
FIG. 12A is a top perspective illustration of the terminal effects of the components of the bullet of FIG. 11A.
Figure 12B:
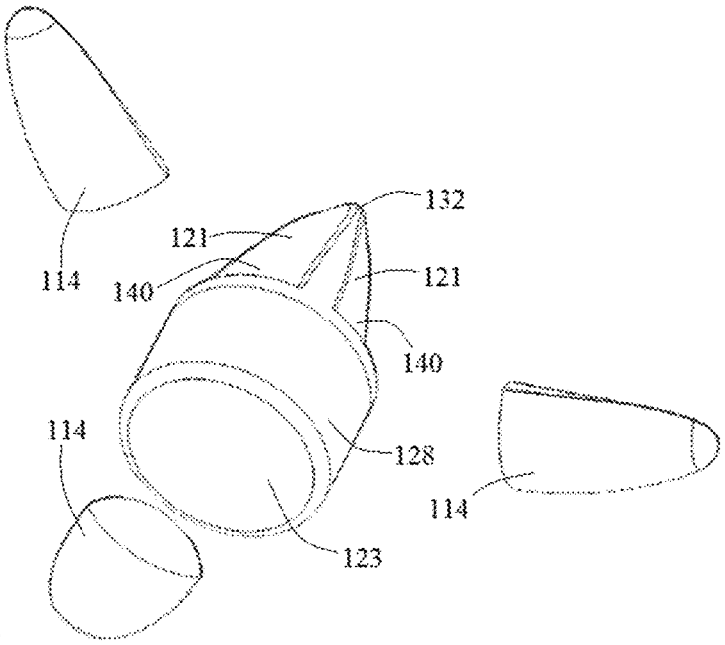
FIG. 12B is a bottom perspective illustration of the terminal effects of the components of the bullet of FIG. 11A.

The fracturing of the segments 114 provide axially extending cut-out regions 140 defined on the forward exterior surface of the projectile 110, presenting a profile that facilitates tumbling of the base 128 and pillar portion 132 of the projectile 110 in the target, as shown in FIGS. 12A and 12B. After the segments 114 break away from the base 128, the center of gravity of the remaining base/pillar portion is shifted rearward in the base 128, also promoting tumbling.

In other embodiments, the segments 114 may be adjacent to one another. The cuts or gaps 118 extend, in the embodiments of FIGS. 11A-14, at least 30% of the axial length 124 of the bullet 110. In embodiments, the gaps 118 extending at least 20% of the axial length of the bullet 110. In embodiments, the gap extending at least 50% of the axial length of the bullet. In embodiments, the gap extending at least 60% of the axial length of the bullet.

Figure 13A:
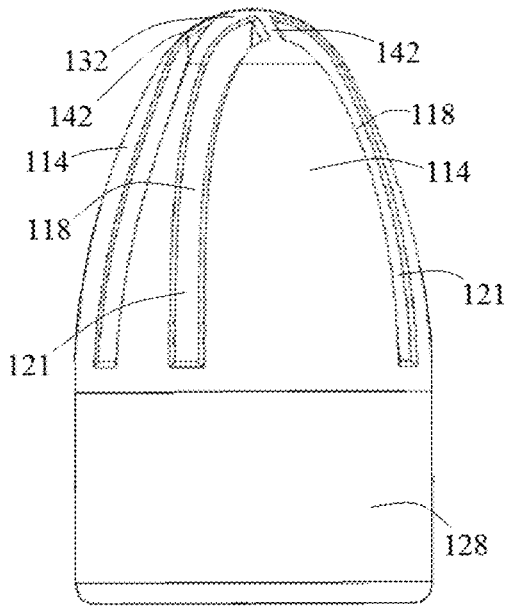
FIG. 13A is a side plan view of another embodiment of a projectile.
Figure 13B:
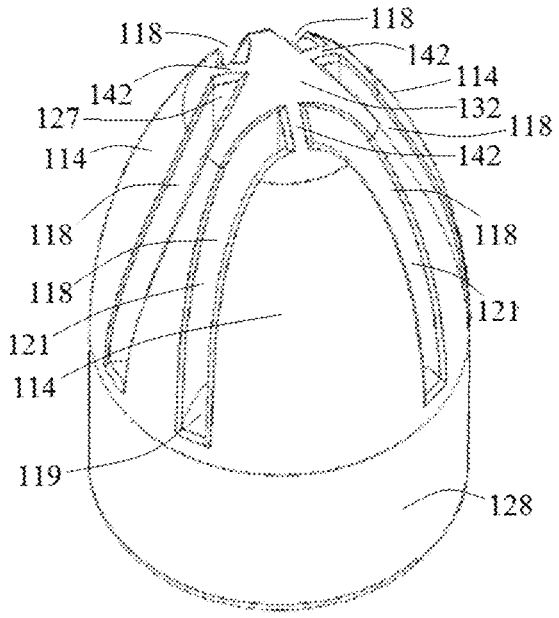
FIG. 13B is a front top perspective view of the projectile of FIG. 13A.
Figure 13C:
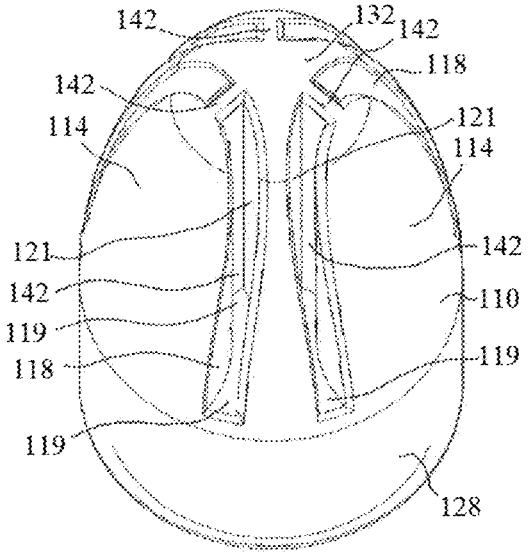
FIG. 13C is a front top perspective view of the projectile of FIG. 13A.
Figure 13D:
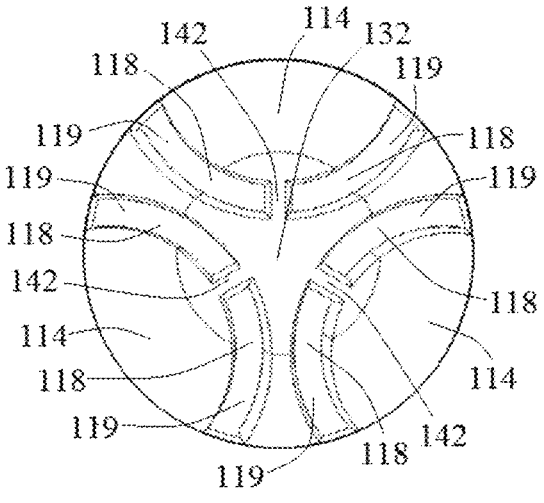
FIG. 13D is a top plan view of the projectile of FIG. 13A.

FIGS. 13A-14 illustrate further embodiments of unitary bullets that may fragment as shown in FIGS. 12A-12B. Whereas FIGS. 11A-11E may have arcuate cuts or gaps 118, the embodiment of FIG. 14 has V-shaped cuts or gaps 118, when viewed from the forward end in an axial direction. FIGS. 13A-13D includes bridge or webbing 142 that extend between a side wall 121 of the pillar portion 132 and the segments 114. The bridge or webbing 142 may extend the axial length 122 of the gaps 118, from the floors 119 of the gaps 118 to the forward end of the segments 114. In embodiments, the bridge or webbing 142 may extend a portion of the axial lengths 122. In some embodiments, the bridge or rib portion 142 comprises two or more axially separated bridges or webbing aligned along the axial length 122 in a gap 118, connecting the pillar portion 132 and the segment 114. Depending on the bullet material, the bridge or webbing 142 may be useful for providing bullet integrity when passing through materials such as drywall, clothing, glass, and other materials.

The projectiles of FIGS. 11A-14 may be made of conventional materials including metals, polymers, metal polymer composites and other materials. In embodiments, the projectile 110 may comprise a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof and a binder selected from the group consisting of a thermoplastic, a thermosetting polymer, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, a phenol formaldehyde polymer, a polymethylmethacrylate polymer, an amorphous polymer, a low crystallinity polymers, polycarbonate, a thermoplastic elastomer, phenolics, epoxies, dialylphthalates, acrylics, polystyrenes, polyethylene, and combinations thereof. The first metal can comprise an amount of from 50 percent by weight to 99.5 percent by weight, based on the total weight of the composition. See U.S. Patent Publication US 2016/231093, which is herein incorporated by reference for all purposes.

Figure 11A:
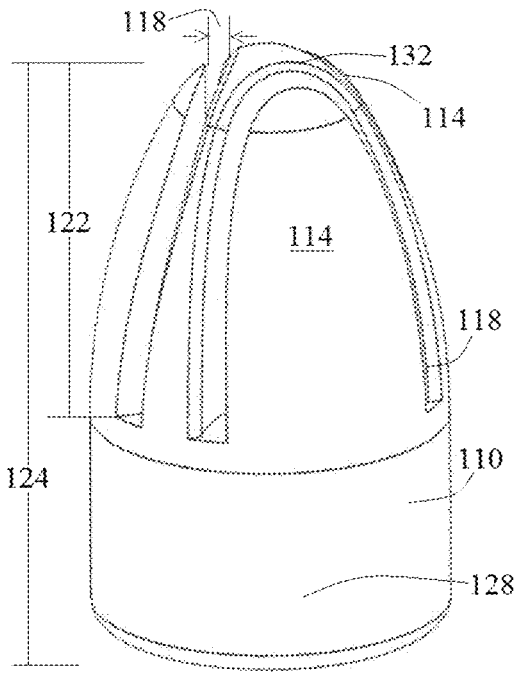
FIG. 11A is a perspective view of a projectile according to an embodiment.
Figure 11B:
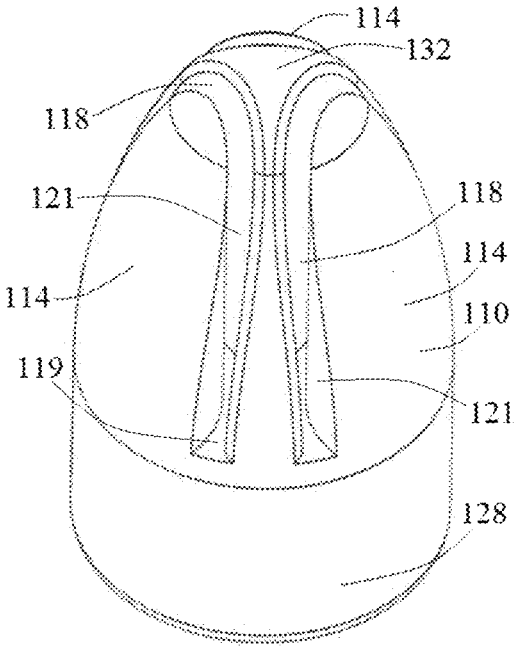
FIG. 11B is a front top perspective view of the projectile of FIG. 11A.
Figure 11C:
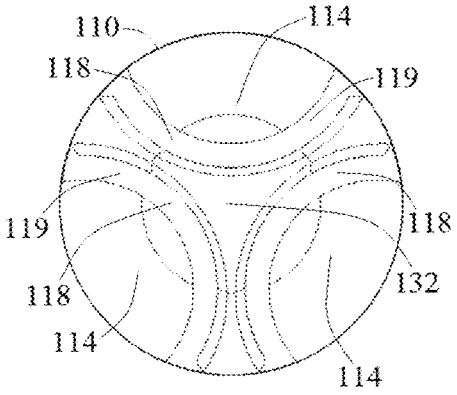
FIG. 11C is a top plan view of the projectile of FIG. 11A.
Figure 11D:
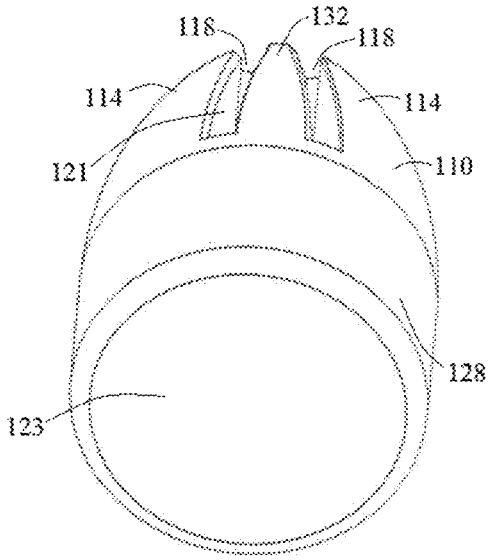
FIG. 11D is a bottom perspective view of the projectile of FIG. 11A.
Figure 11E:
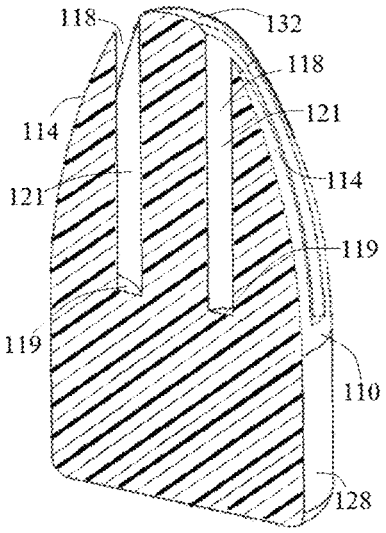
FIG. 11E is a cross-sectional view of the projectile of FIG. 11A.

In embodiments, the bullets 110 may be formed by injection molding, such that the bullet 110 is formed as a unitary piece with formed gaps 118 and segments 114, as shown in FIG. 11E.

Suitable methods for manufacturing the multi-core bullets described herein include: Inserting a jacket preform into a die. Dropping a first lead ball into the jacket preform and pressing the lead ball into the jacket to form the rearward core member 54. A multistage press is suitable to using in the pressing steps. The press is configured to impart a desired shape to the forward end of the rearward core member 54 for the desired fit for juncture 55. A second lead ball is dropped onto the formed rearward core pressed down onto the rearward core in the jacket, deforming the second ball to conform to the jacket and the forward surface of the rearward core. The combined reward core member, forward core member and jacket are then inserted forward core component end first into a skiving die to form the segments. Appropriate shaped punches and/or blades are used to form the planer separations to separate the segments as desired. The combined reward core member, forward core member and jacket are then moved to a finishing die to be swaged to obtain the final bullet shape. Other and additional steps may, of course, be utilized.

The following references are hereby incorporated by reference herein except for express definitions and patent claims contained therein: U.S. Patent Application Publication No. 2006/0283314; U.S. Patent Application Publication No. 2006/0027129; U.S. Pat. Nos. 9,863,746; 5,399,187; 5,665,808; 7,503,260; and 6,048,379. Any incorporation by reference of documents above is limited such that no subject matter is incorporated that is contrary to the explicit disclosure herein.

Each of the figures and methods disclosed herein can be used separately, or in conjunction with other features and methods, to provide improved devices and methods for making and using the same. Therefore, the specific combinations of features and methods disclosed herein may not be necessary to practice the disclosure in its broadest sense and are instead disclosed merely to particularly describe representative embodiments.

Various modifications to the embodiments may be apparent to one of skill in the art upon reading this disclosure. For example, persons of ordinary skill in the relevant art will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

The invention is not restricted to the details of the foregoing embodiments. The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A handgun cartridge comprising a cartridge casing with a mouth and an interior, propellant in the interior of the cartridge casing, and a bullet secured in the mouth of the cartridge casing, the cartridge and bullet have a central axis, the bullet having an overall length and a maximum diameter, the ratio of the overall length to the maximum diameter is equal to or less than about 2:1, the bullet comprising:

a jacket member comprising a rearward wall having a generally circular shape and a circumferential wall extending forwardly from the rearward wall, the circumferential wall having a forward margin;

a rearward core member disposed inside the jacket member, the rearward core member having a cylindrical exterior surface engaging an inside surface of the circumferential wall, a forward facing surface, and a rearward facing surface, the rearward facing surface of the rearward core member being seated against a forward facing surface of the rearward wall of the jacket member;

a forward core member disposed inside the jacket member forward of and non-unitary with the rearward core member, the forward core member having a rear face, wherein the forward facing surface of the rearward core member and the rear face of the forward core member meet at a juncture;

the forward core member comprising a plurality of core segments extending axially forwardly from the rear face of the forward core member, the plurality of segments arranged circularly around the central bullet axis and defining a bullet tip with an axially extending recess at said tip, adjacent pairs of the forward core segments having segment faces engaged with each other defining a separation juncture, wherein the core segments are configured to be separable from one another at said separation junctures and are separable from the rearward core member at the juncture between the forward facing surface of the rearward core member and the rear face of the forward core member and dispersible radially outwardly in an array when the bullet strikes a target.

2. The handgun cartridge of claim 1, wherein the plurality of core segments numbers from 3 to 8.

3. The handgun cartridge of claim 1, wherein the axially extending recess at the bullet tip has a depth, and wherein the separation junctures have an axial length, and the axial length of the separation junctures is greater than the depth of the axially extending recess.

4. The handgun cartridge of any one of claim 1, wherein each said separation juncture extends axially entirely through the forward core member along the central axis.

5. The handgun cartridge of claim 4 wherein the forward core member has an outer circumferential surface and an axial length, and wherein each said separation juncture extends entirely the axial length of the forward core member at the central axis and does not extend the axial length of the forward core member at the outer circumferential surface.

6. The handgun cartridge of claim 1, wherein one the forward core member and rearward core member comprises a material selected from the group consisting of: steel, lead, copper, ETP copper, copper alloys, brass, bronze, carbides, tungsten, tungsten carbide, silicon carbide, tungsten heavy alloys, aluminum, aluminum alloys, iron, polymers, polymer matrixes, fiber-reinforced polymers, carbon composite materials, bismuth alloys, tin alloys, and ceramics.

7. The handgun cartridge of claim 1, wherein the jacket member has a plurality of axially extending tear guides extending rearwardly from the forward margin, wherein the axially extending tear guides are at least one of skives, folds, and slits.

8. The handgun cartridge of claim 1, wherein the jacket member, the forward core member and the rearward core member are configured for releasing the forward core member and retaining the rearward core member upon impact.

9. The cartridge of claim 1, wherein the jacket member comprises a plurality of axially extending tear guides extending rearwardly from the forward margin, whereby when the bullet strikes a target the jacket may petal outwardly.

* * * * *